US006910935B2

(12) United States Patent
Arai et al.

(10) Patent No.: US 6,910,935 B2
(45) Date of Patent: Jun. 28, 2005

(54) METHODS AND MANUFACTURING ELECTRON-EMITTING DEVICE, ELECTRON SOURCE, AND IMAGE-FORMING APPARATUS

(75) Inventors: Yutaka Arai, Kanagawa (JP); Takashi Iwaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 10/359,601

(22) Filed: Feb. 7, 2003

(65) Prior Publication Data

US 2003/0160180 A1 Aug. 28, 2003

(30) Foreign Application Priority Data

Feb. 28, 2002 (JP) ..... 2002-054168

(51) Int. Cl.[7] ..... H01J 9/04

(52) U.S. Cl. ..... 445/24; 445/5; 445/51; 438/20

(58) Field of Search ..... 445/3, 5, 6, 24, 445/25, 49–51; 313/495–497, 346 R; 438/20

(56) References Cited

U.S. PATENT DOCUMENTS

| | | | | |
|---|---|---|---|---|
| 6,123,876 | A | 9/2000 | Kobayashi et al. | 252/519.2 |
| 6,179,678 | B1 | 1/2001 | Kishi et al. | 445/24 |
| 6,221,426 | B1 | 4/2001 | Yamanobe | 427/77 |
| 6,334,803 | B1 | 1/2002 | Shibata | 445/51 |
| 6,366,015 | B1 | 4/2002 | Shibata | 313/495 |
| 6,383,047 | B1 | 5/2002 | Minami et al. | 445/6 |
| 2002/0081931 | A1 | 6/2002 | Iwaki et al. | 445/6 |
| 2002/0090877 | A1 | 7/2002 | Minami et al. | 445/6 |
| 2002/0117670 | A1 | 8/2002 | Horiguchi et al. | 257/59 |
| 2003/0039767 | A1 | 2/2003 | Mizuno et al. | 427/595 |
| 2003/0073371 | A1 | 4/2003 | Iwaki | 445/24 |
| 2003/0082981 | A1 | 5/2003 | Takegami et al. | 445/6 |
| 2003/0124944 | A1 | 7/2003 | Kyogaku | 445/6 |
| 2003/0161942 | A1 | 8/2003 | Arai et al. | 427/77 |
| 2003/0162464 | A1 | 8/2003 | Kyogaku et al. | 445/24 |
| 2003/0162465 | A1 | 8/2003 | Mizuno et al. | 445/24 |
| 2003/0162467 | A1 | 8/2003 | Shimazu et al. | 445/50 |

FOREIGN PATENT DOCUMENTS

| | | |
|---|---|---|
| EP | 0 788 130 A2 | 8/1997 |
| EP | 0 803 890 A1 | 10/1997 |
| EP | 0 986 085 A2 | 3/2000 |
| EP | 1 124 247 A1 | 8/2001 |
| EP | 0 736 890 B1 | 7/2002 |
| JP | 7-65704 | 3/1995 |
| JP | 8-55563 | 2/1996 |
| JP | 8-321254 | 12/1996 |
| JP | 9-161666 | 6/1997 |
| JP | 9-237571 | 9/1997 |
| JP | 11-120901 | 4/1999 |

*Primary Examiner*—Joseph Williams
*Assistant Examiner*—German Colón
(74) *Attorney, Agent, or Firm*—Fitzpatrick, Cella, Harper & Scinto

(57) ABSTRACT

A method of manufacturing an electron source, comprising the steps of (A) providing a substrate on which are disposed a plurality of units, each unit including a pair of electrodes and a polymer film connecting the pair of electrodes, and (B) selecting one or more units from the plurality of units. The method also comprises (C) applying a potential difference across the pair of electrodes that is included in each of the selected one or more units, and (D) irradiating light or a particle beam to the polymer film included in each of the selected one or more units in a state of being applied with the potential difference. Step (D) preferably is started after step (C) is started.

14 Claims, 15 Drawing Sheets

METHODS AND MANUFACTURING ELECTRON-EMITTING DEVICE, ELECTRON SOURCE, AND IMAGE-FORMING APPARATUS

BACKGROUND OF THE INVENTION

1. Field of the Invention

The present invention relates to a method of manufacturing an electron-emitting device, a method of manufacturing an electron source structured by arranging the plurality of electron-emitting devices, and a method of manufacturing an image-forming apparatus, such as a display apparatus, which is structured by using the electron source.

2. Related Background Art

In recent years, studies have been made on various electron sources each of which is structured by arranging a large number of electron-emitting devices in order to aim at application of an image-forming apparatus or the like. Among the electron sources, one is known in which a surface conduction electron-emitting device is used as an electron-emitting device. The structure, manufacturing method, and the like of the surface conduction electron-emitting device are disclosed in, for example, Japanese Patent Application Laid-Open No. 08-321254.

The general structures of a surface conduction electron-emitting device and an electron source, which are disclosed in the above-mentioned publication or the like, are schematically shown in FIGS. 12A and 12B and FIGS. 13A and 13B. FIGS. 12A and 12B are respectively a plan view and a sectional view of the electron-emitting device disclosed in the above publication or the like. Further, FIG. 13A is a plan view showing an example of a structure of the electron source disclosed in the above publication or the like, and FIG. 13B is a sectional view taken along the line 13B—13B of FIG. 13A.

In FIGS. 12A and 12B, reference numeral 1 denotes a substrate; 2 and 3, a pair of electrodes facing each other; 400, a conductive film; 5, a second gap; 600, a film chiefly composed of carbon; and 7, a first gap.

FIGS. 13A and 13B schematically show an example of an electron source structured by arranging the plurality of electron-emitting devices shown in FIGS. 12A and 12B. In FIGS. 13A and 13B, electron-emitting devices of 3 rows×3 columns are arranged, and the electrodes 2 and the electrodes 3 of the respective devices are connected via wirings 8 and wirings 9, respectively, to thereby form a passive matrix structure. Note that an insulating layer 10 is provided at an intersection portion of the wirings.

A method of manufacturing the electron source shown in FIGS. 13A and 13B is described with reference to FIGS. 14A to 14F.

A plurality of pairs of the electrodes 2 and 3 are first formed on the substrate 1 (FIG. 14A).

Next, each of the wirings 8 is formed for a plurality of pairs of the electrodes 2 and 3 so as to connect with the electrodes 2 on one side (FIG. 14B).

The insulating layer 10 is formed at an intersection portion of each of the wirings 8 and each of the wirings 9 described later (FIG. 14C).

The wirings 9 that pass over the insulating layers 10 are formed (FIG. 14D).

Subsequently, the conductive film 400 for connecting between the electrodes 2 and 3 is formed (FIG. 14E).

Then, a current is made to flow between the electrodes 2 and 3 via the wirings 8 and 9, and the so-called "forming step" is performed for forming the second gap 5 in a part of the conductive film 400 (FIG. 14F).

Further, in a carbon compound atmosphere, a voltage is applied between the electrodes 2 and 3 via the wirings 8 and 9 to perform the so-called "activation step" by which the carbon film 600 is formed on a part of the substrate 1 within the second gap 5 and is also formed on a part of the conductive film 400 in the vicinity of the second gap 5, thus forming each device in FIG. 14F, which is the electron-emitting device shown in FIGS. 12A and 12B.

On the other hand, another method of manufacturing a surface conduction electron-emitting device is disclosed in Japanese Patent Application Laid-Open No. 9-237571.

The electron source structured by arranging a plurality of electron-emitting devices which are manufactured by the above manufacturing method is combined with a light emitting member for emitting light due to irradiation of electrons emitted from an electron source such as a phosphor, thereby being capable of structuring an image-forming apparatus such as a flat display panel.

SUMMARY OF THE INVENTION

In the above-described conventional electron source, in addition to the "forming step", the "activation step" and the like are performed on the devices in the manufacturing method. Consequently, good electron emission characteristics are obtained.

However, the manufacturing method of such a conventional electron source has the following problems.

That is, the manufacturing method include many additional steps such as repeated energization steps in the "forming step" and the "activation step" and a step of forming a preferable atmosphere in each step, and thus, management of the steps is difficult to be simplified.

Further, in the case where the electron source as described above is used for an image-forming apparatus such as a display, further improvement in characteristics of electron-emitting devices that constitute the electron source is desired in order to reduce power consumption of the apparatus.

Moreover, it is desired that the image-forming apparatus, which uses the electron source as described above, be manufactured at lower cost and with high yield in an easier and simpler manner.

The present invention has been made to solve the above problems, and therefore has an object to provide a method of manufacturing an electron source which particularly attains simplification of manufacturing steps of the electron source and improvement of electron-emitting characteristics of devices, and a method of manufacturing an image-forming apparatus.

The present invention has been made as a result of extensive studies for solving the above-mentioned problems and has the structures described below.

That is, according to a first aspect of the present invention for solving the above problems, the present invention relates to a method of manufacturing an electron source comprising the following series of steps:

(A) providing a substrate on which a plurality of units, each unit including a pair of electrodes and a polymer film of connecting the pair of electrodes;

(B) selecting one or more units from the plurality of units;

(C) applying a potential difference across the pair of electrodes that is included in each of the slelected one or more units; and (D) irradiating light or a particle beam to the polymer film included in each of the selected one or more units in a state of being applied with the potential difference.

And, particularly, this manufacturing method is unique in the respect that the step (D) is started after the step (C) is started.

The first aspect of the present invention includes, as preferred modes,

"that the light or particle beam is sequentially irradiated to the polymer film that is included in each of the selected one or more units in a state of being applied with the potential difference, "the step (B), step (C) and step (D) are repeatedly performed, thereby forming a gap in each of all the polymer films that are included in the respective units", "that the light is laser", "that the light is light emitted from a xenon lamp or a halogen lamp", "that the particle beam is an electron beam or an ion beam", and "that the polymer film is comprised of any of aromatic polyimide, polyphenylene oxadiazole, and polyphenylene vinylene".

According to a second aspect of the present invention, the present invention relates to a method of manufacturing an image-forming apparatus, which has an electron source; and a light emitting member for emitting light due to irradiation of electrons emitted from the electron source, wherein the electron source is manufactured in accordance with the method according to the first aspect of the present invention.

According to a third aspect of the present invention, the present invention relates to a method of manufacturing an electron-emitting device comprising the following series of steps:

(A) providing a substrate with an unit including a pair of electrodes and a polymer film of connecting the pair of electrodes; and (B) applying a potential difference across the pair of electrodes; and (C) irradiating light or a particle beam to the polymer film in a state of being applied with the potential difference.

And, particularly, this manufacturing method is unique in the respect that the step (C) is started after the step (B) is started.

According to the present invention, the manufacturing method can be remarkably simplified compared with a conventional method of manufacturing an electron source which requires a step of forming a conductive film, a step of forming a gap in the conductive film (forming step), a step of forming an atmosphere containing an organic compound (or step of forming a polymer film on a conductive film), and a step of forming the carbon film by energization of a conductive film while simultaneously forming a gap in the carbon coating film (activation step). That is, the step of forming a carbon film is not required, and the steps required for obtaining a structure of an electron-emitting device can be remarkably reduced, which enables reduction and simplification of the manufacturing steps.

Further, the electron-emitting device similar to the electron-emitting device manufactured by the manufacturing method of the present invention can be also manufactured in accordance with a method of performing irradiation of an energy beam to lower resistance in a polymer film and then forming a gap through voltage application. However, according to the manufacturing method of the present invention, it is possible to make more appropriate judgement on the gap formation described below to promptly complete the steps.

Moreover, with the reason that the carbon film which constitutes the electron-emitting device (which is described later) has satisfactory heat-resistance or other reason, an improvement in electron-emitting characteristics, which has been restricted by heat-resistance of a conductive film, or the like in the prior art, that is, an improvement in performance of an electron source can be attained.

BRIEF DESCRIPTION OF THE DRAWINGS

FIGS. 1A and 1B are a schematic plan view and a schematic sectional view showing an example of an electron source manufactured by a method of manufacturing an electron source according to the present invention, in which FIG. 1A is a plan view and FIG. 1B is a sectional view taken along the line 1B—1B of FIG. 1A;

FIGS. 2A and 2B are a schematic plan view and a schematic sectional view showing an example of an electron-emitting device constituting an electron source manufactured by a method of manufacturing an electron source according to the present invention, in which FIG. 2A is a plan view and FIG. 2B is a sectional view;

FIGS. 12A and 12B are schematic diagrams showing a structure of a conventional surface conduction electron-emitting device, in which FIG. 12A is a plan view and FIG. 12B is a sectional view taken along the line 12B—12B of FIG. 12A;

FIGS. 13A and 13B are schematic diagrams showing a structure of a conventional electron source, in which FIG. 13A is a plan view and FIG. 13B is a sectional view taken along the line 13B—13B of FIG. 13A;

DESCRIPTION OF THE PREFERRED EMBODIMENTS

Hereinafter, description will be made of embodiments of the present invention. However, the present invention is not limited to these embodiments.

Figure 1A:
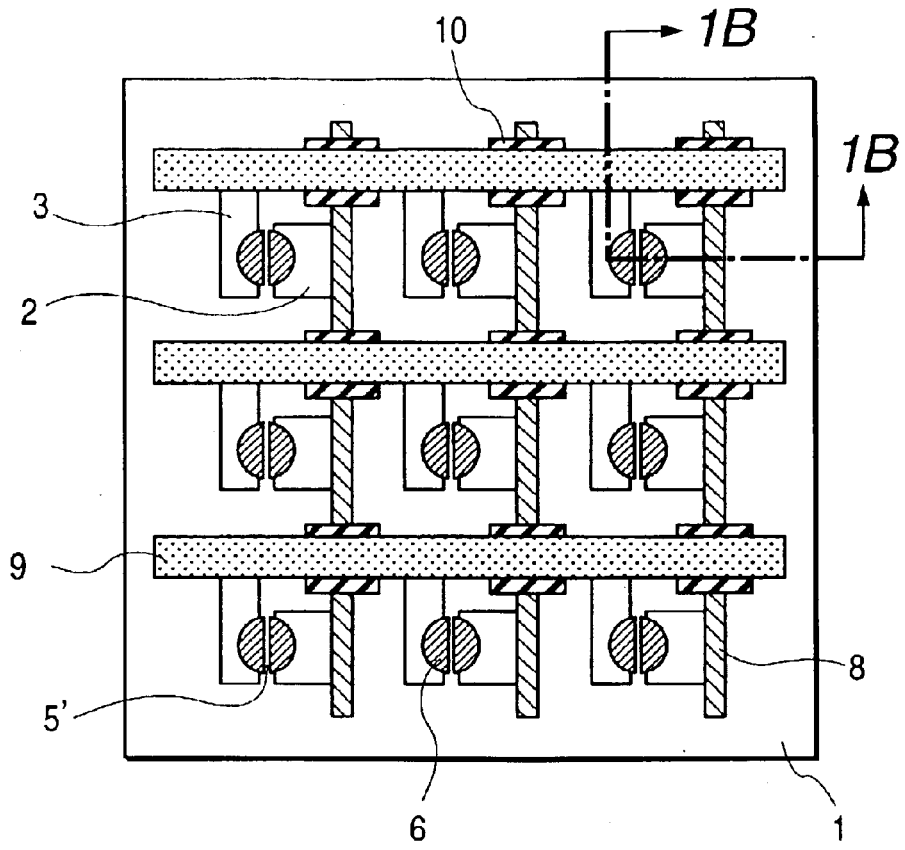
Figure 1B:
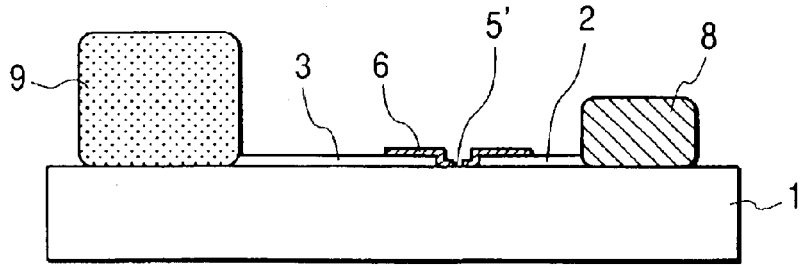

FIGS. 1A and 1B show an electron source manufactured according to a manufacturing method of the present invention. Note that, FIG. 1A is a plan view and FIG. 1B is a sectional view taken along the line 1B—1B of FIG. 1A.

In FIGS. 1A and 1B, reference numeral 1 denotes a substrate (rear plate) constituting an electron source. Reference numeral 2 and 3 denotes electrodes of each electron-emitting device. Reference numeral 8 and 9 denotes wirings. Reference numeral 10 denotes an insulating layer. Reference numeral 6 denotes a conductive film (also called "conductive film mainly containing carbon" or "film obtained by performing a resistance lowering process on a polymer film", or simply called "carbon film", and hereinafter referred to as carbon film). Reference numeral 5' denotes a gap. In the figures, the carbon film 6 is formed on the substrate 1 between the electrodes 2 and 3.

In the electron source shown in FIGS. 1A and 1B, when a sufficient electric field is applied to the gap 5' of each electron-emitting device through the wirings 8, 9 and the electrodes 2, 3, electrons tunnel through the gap 5' to cause a current to flow between the electrodes 2 and 3. The tunnel electrons partially scatter and then a part of the scattered electrons are drawn to an anode electrode (not shown) which is disposed above the substrate 1 due to a high voltage applied to the anode electrode.

Figure 2A:
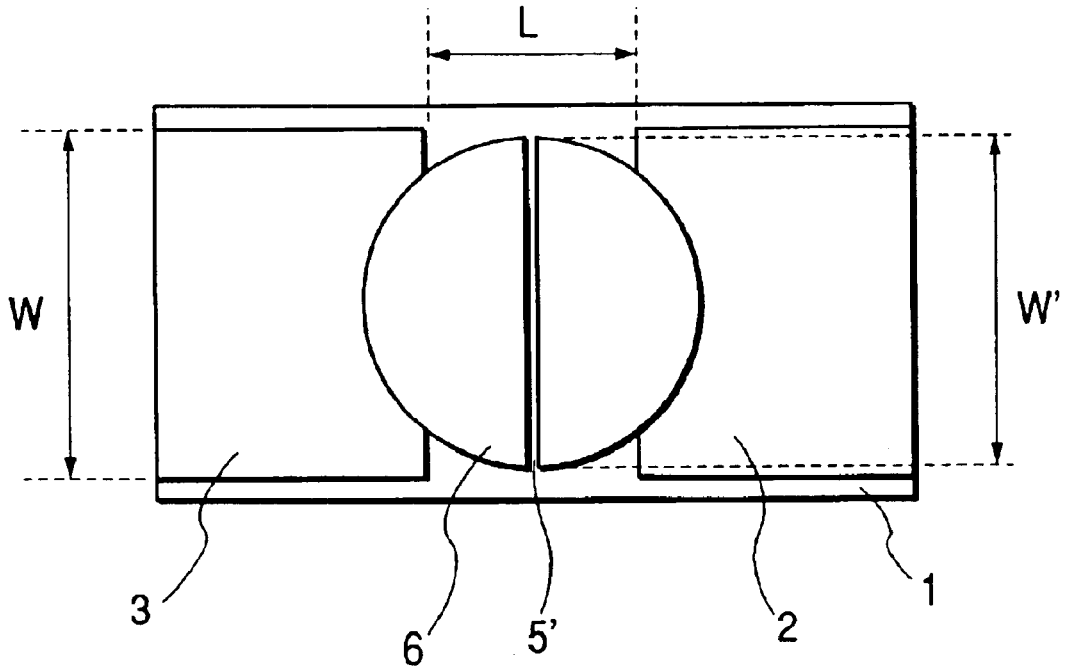
Figure 2B:
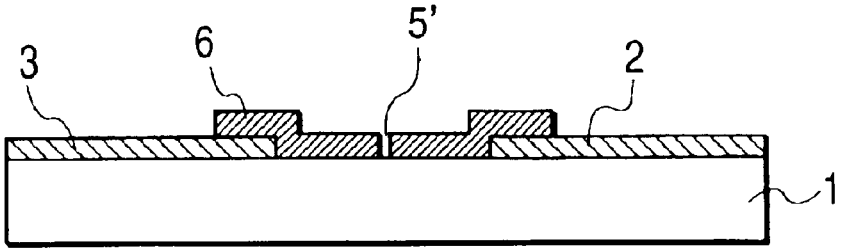

The carbon film 6 of the electron-emitting device of the present invention is in a form of a polymer film 6' at an initial stage. FIGS. 2A and 2B are views showing a part of the electron-emitting device taken out of the electron source shown in FIGS. 1A and 1B, which corresponds to an example of the electron-emitting device of the present invention. FIG. 2A is a plan view and FIG. 2B is a sectional view.

Next, referring to FIGS. 2A to 3D, a method of manufacturing an electron-emitting device will be described.

Figure 3A:
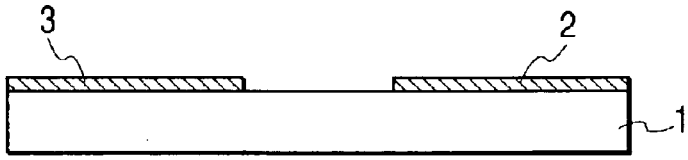
FIGS. 3A, 3B, 3C and 3D are schematic sectional views showing an example of a method of manufacturing an electron-emitting device constituting an electron source according to the present invention.
Figure 3B:
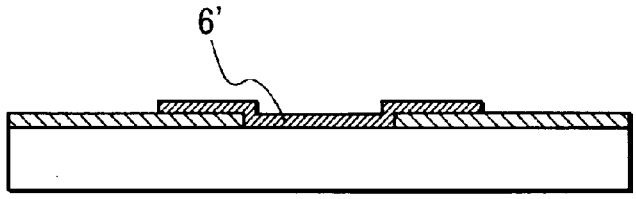

On the substrate, the electrodes 2 and 3 are formed so as to obtain an electrode length W and a gap L between the electrodes (FIG. 3A) and then the wirings are connected to the electrodes. The polymer film 6' is formed on the electrodes 2 and 3, and the substrate 1 with a device length W' so as to cover the gap between the electrodes (FIG. 3B).

Figure 3C:
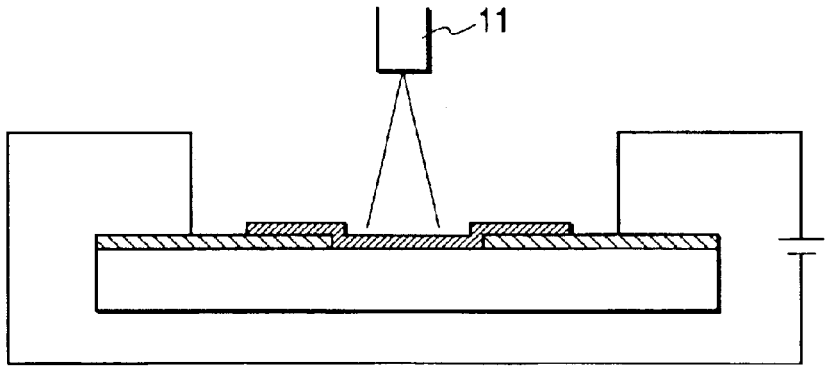
Figure 3D:
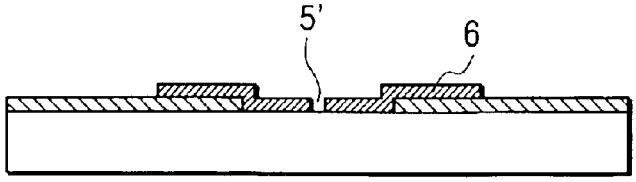

A constant potential difference is started to be applied across a pair of electrodes of the electron-emitting device and then irradiating a particle beam such as an electron beam or an ion beam, or light from an irradiating means 11 to the polymer film 6' connecting between the electrodes in a state of being given the potential difference is started (FIG. 3C). Thus, the polymer film 6' develops conductivity (polymer film 6' is subjected to resistance (resistivity) lowering) and at that same time, a current flows to further generate heat to form the gap 5' in the film obtained by subjecting the polymer film to resistance lowering (in the film obtained by reducing a resistivity of the polymer film), thereby the carbon film 6 having the gap 5' is formed (FIG. 3D).

Here, the "polymer film" defined in the present invention will be described.

A polymer refers to a compound with such a molecular weight as to cause no change in physical and chemical properties thereof. And the "polymer" in the present invention refers to one having at least a bond between carbon atoms. As a lower limit of the molecular weight, a definite value is not regulated. However, in general, the molecular weight of the polymer in the present invention is 5,000 or more, and preferably 10,000 or more.

In the present invention, the polymer (polymer film) having an ability of developing (increasing) its conductivity by irradiating the particle beam such as an electron beam or an ion beam, or light is used.

As such polymers, an aromatic polymer having an aromatic ring is preferable. This is because such polymers inherently have a structure similar to that of graphite having conductivity and easily store conjugated electrons therein. Particularly in aromatic polyimide, an aromatic ring and an imide group exist in a planar shape in its backbone and the structure similar to that of graphite can be easily obtained by the resistance lowering process of the present invention. As a result, it can be particularly expected for the aromatic polyimide to have conductivity.

Also, polymers such as polyphenylene oxadiazole and polyphenylene vinylene can be also used preferably in the present invention.

The present invention preferably adopts the aromatic polymer as described above. On the other hand, in general, those polymers are almost insoluble in a solvent. Consequently, a precursor solution of the polymer is preferably used. When the precursor solution of the polymer is used to obtain a polymer film, the solution is applied on a substrate and then the substrate is heated to remove a solvent and to change the precursor to the polymer. As for an example thereof, an inkjet method is adapted to apply (droplet application) a polyamide acid solution as a precursor of the aromatic polyimide, thereby being capable of forming the polyimide film through heating or the like. The ink-jet method is suitable for a large substrate because the method can be applying a necessary amount of the solution onto necessary positions in the surface of the substrate.

Note that, a solvent for dissolving polyamide acid may be selected from the group consisting, for example, of N-methyl-pyrrolidone, N,N-dimethyl acetamide, N,N-dimethyl formamide, and dimethyl sulfoxide. In addition, n-butyl cellosolve, triethanolamine, or the like may be additionally used in combination with such a solvent. However, it is not particularly limited to specific one as long as the present invention is applicable thereto and the solvent is not limited to one of those listed above.

In the present invention, while a constant potential difference is applied between the electrodes constituting the electron-emitting device, the polymer film 6' is irradiated with the particle beam such as an electron beam, an ion beam, etc., or light. Here, the applied potential difference can be previously determined as follows. That is, a dummy electron-emitting device (a reference) is manufactured and the potential difference to be applied is determined in advance on the basis of the results obtained from the manufactured device. For example, the polymer film of the dummy device is irradiated with the particle beam represented by an electron beam, an ion beam, etc., or light to thereby lower the resistance (resistivity) of the polymer film 6'. After the resistance lowering of the polymer film 6', the voltage is applied between the electrodes to form the gap 5'. At this time, if the applied voltage is increased stepwise, the potential difference can be made definite when no current flows between the electrodes due to formation of the gap. Thus, assuming that the potential difference at this time is represented by Vform (V), the potential difference previously applied to the polymer film 6' in the present invention is set to the one in the vicinity of Vform (V), preferably to Vform (V) with a margin of ±0.5 V.

In the present invention, in a state in which the above described potential difference is applied across the pair of electrodes (while the above described potential difference is applied), the polymer film 6' is irradiated with the particle beam represented by an electron beam, an ion beam, etc., or light. Therefore, the resistance (resistivity) lowering process and a gap forming process may be simultaneously performed on the polymer film.

In the present invention, for the irradiation, the particle beams such as an electron beam and an ion beam, or light may be used. Among those, any one can be irradiated onto the polymer film 6' to be turned into the carbon film (film obtained by performing the resistance lowering process on the polymer film) 6 as described above. A description will be given of the respective characteristics below.

When the particle beam such as an electron beam or an ion beam is irradiated to the polymer film 6', the substrate with the polymer film 6' is held in a vacuum and beam is irradiated from a particle beam source such as an electron beam gun similarly held in a vacuum. For example, when the electron beam is adapted thereto, as the electron gun to be used, ones with various acceleration voltages can be used. It is desirable to use an electron gun capable of converging the beam into an arbitrary size. The mechanism of increasing the conductivity of the polymer film has not been clearly understood. The inventors of the present invention have supposed that when the particle beam such as an electron beam abuts against the polymer film 6', the particles such as electrons are accelerated and their energy propagates to thereby heat the polymer film 6'. Note that, irradiating the particle beam is preferably used as compared with the irradiation of the light, because the polymer film 6' can express conductivity irrespectively of the light absorbing.

On the other hand, upon the light irradiation, the light emitted from the light source is guided into a vacuum through fiber etc., and irradiated onto the polymer film on the substrate placed in a vacuum. In addition, the light irradiation can be also conducted even if the substrate is placed in an inert gas atmosphere. Alternatively, only the substrate having the polymer film disposed thereon is placed in a vacuum or in an inert gas atmosphere, and light can be irradiated from the outside through a window made of quartz etc. which allows the light to pass therethrough. As a light source to be used, a laser from a semiconductor laser etc. and in addition, an infrared light using a xenon lamp or halogen lamp as a light source or a visible light can be employed. Generally, the laser is small in spot size, so that output density can be increased. Thus, given as characteristics thereof is short irradiation time to the polymer film. On the other hand, a xenon light or halogen light has large spot size, so that it can be irradiated to the plural polymer films at a time.

Note that, in order to subject only the polymer film 6' to lowering resistance process without imparting any damage to other members, attention should be paid to an irradiation power. As one of characteristics of the irradiation using the particle beam represented by the electron beam, the ion beam, etc., or light, pulse modulation is possible. Thus, if the irradiation pulse is made short upon the high-output irradiation while the irradiation pulse is made long upon the low-output irradiation, it can be also said that there is no limitation on the irradiation power.

Figure 15:
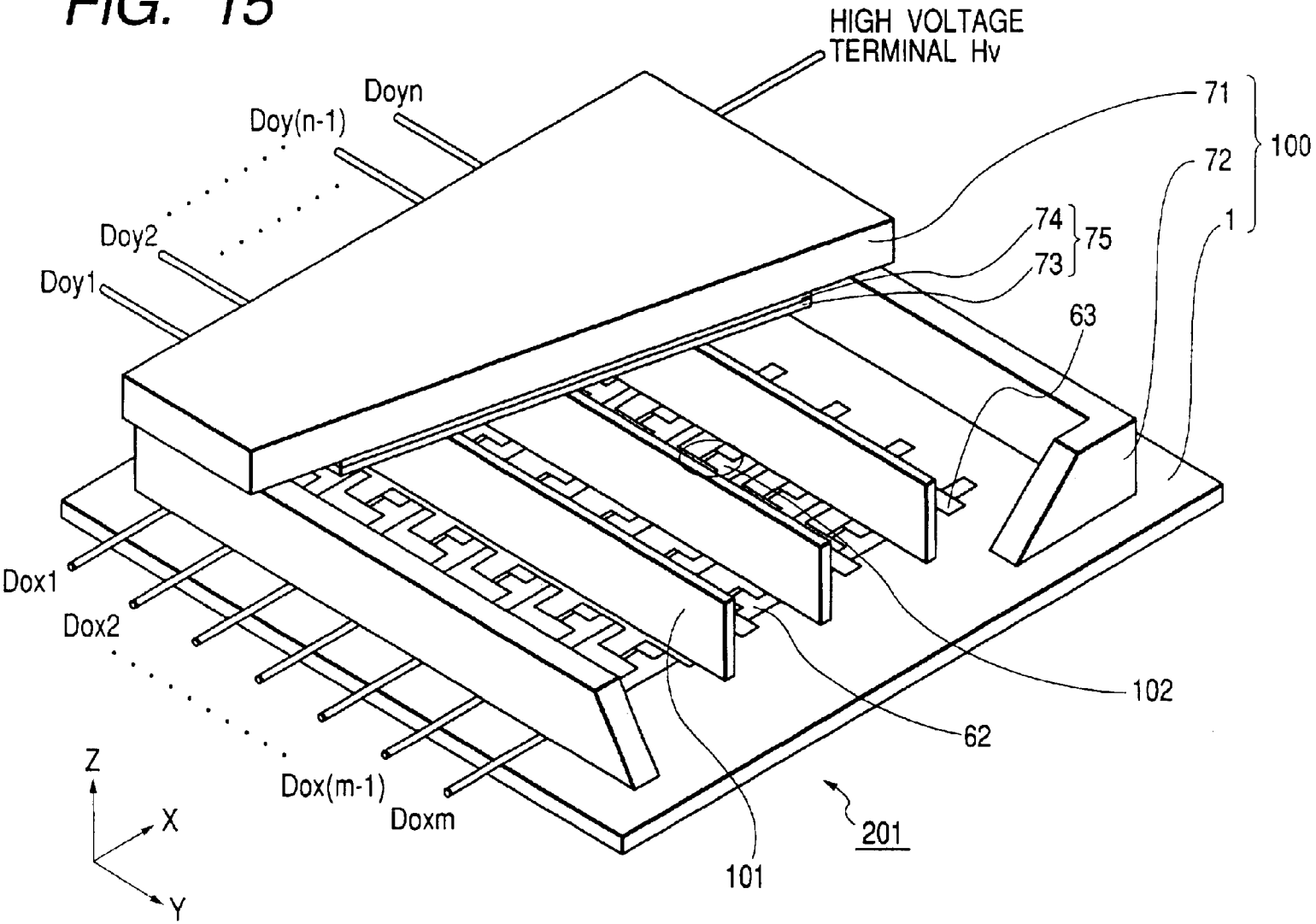
FIG. 15 is a perspective schematic diagram showing an image-forming apparatus according to the present invention.

FIG. 15 is a schematic diagram showing an example of an image-forming apparatus using an electron source manufactured according to the manufacturing method of the present invention. Note that, in FIG. 15, a supporting frame 72 and a face plate 71, which are described later, are partially removed for illustrating the inside of an image-forming apparatus 201.

In FIG. 15, reference numeral 1 denotes a rear plate (corresponding to the substrate of the present invention) in which a large number of electron-emitting devices 102 are arranged; 71, a face plate on which an image-forming member 75 is arranged; 72, a supporting frame for keeping a reduced pressure condition between the face plate 71 and the rear plate 1; and 101, a spacer disposed for holding an interval between the face plate 71 and the rear plate 1. The face place 71, the rear plate 1, and the supporting frame 72 constitute an airtight container 100.

When the image-forming apparatus 201 is a display, the image-forming member 75 is constituted of a phosphor film 74 and a conductive metal back 73. Denoted by 62 and 63 are wirings connected for applying the voltage to the electron-emitting device 102, respectively. Reference symbols Doy1 to Doyn and Dox1 to Doxm indicate lead wirings for connecting between a driver circuit etc. arranged outside the image-forming apparatus and ends of the wirings 62 and 63 led out to the outside from the reduced pressure space of the image-forming apparatus 201 (space surrounded by the face plate, the rear plate, and the supporting frame).

Next, referring, for example, to FIGS. 5 to 11, an example of a method of manufacturing an electron source of the present invention using the above electron-emitting device will be described below together with the description of an example of the method of manufacturing the image-forming apparatus as shown in FIG. 15.

(A) First, the rear plate 1 constituting the electron source is prepared. The rear plate 1 made of an insulating material may be used and particularly, the rear plate 1 made of glass is preferably used.

Figure 5:
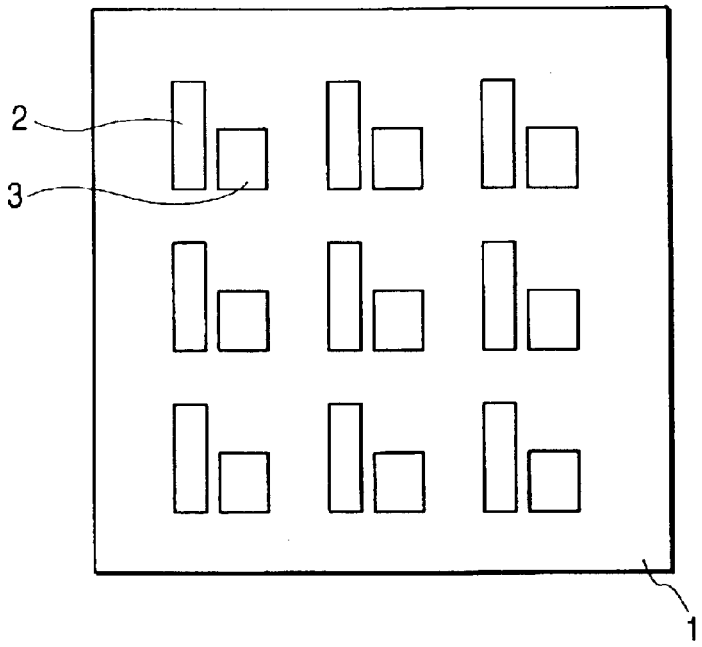
FIG. 5 is a schematic diagram showing an example of a manufacturing step of an electron source in a passive matrix arrangement according to the present invention.

(B) Next, a plurality of pairs of electrodes 2 and 3 shown in FIGS. 1A and 1B are formed on the rear plate 1 (FIG. 5). The electrodes may be formed of a conductive material, but preferably, is formed of a material hardly damaged by the subsequent step (irradiation step of the particle beam represented by the electron beam, the ion beam, etc., or light). In addition, the electrodes 2 and 3 may be formed by using various methods such as a sputtering method, a CVD method, and a printing method. Note that, in FIG. 5, for simplifying the explanation, there is shown an example in which nine pairs of electrodes in total, i.e., three pairs of electrodes in the X direction and three pairs of electrodes in the Y direction, are formed. However, the number of the pairs of electrodes is appropriately set depending on the resolution of the image-forming apparatus.

Figure 6:
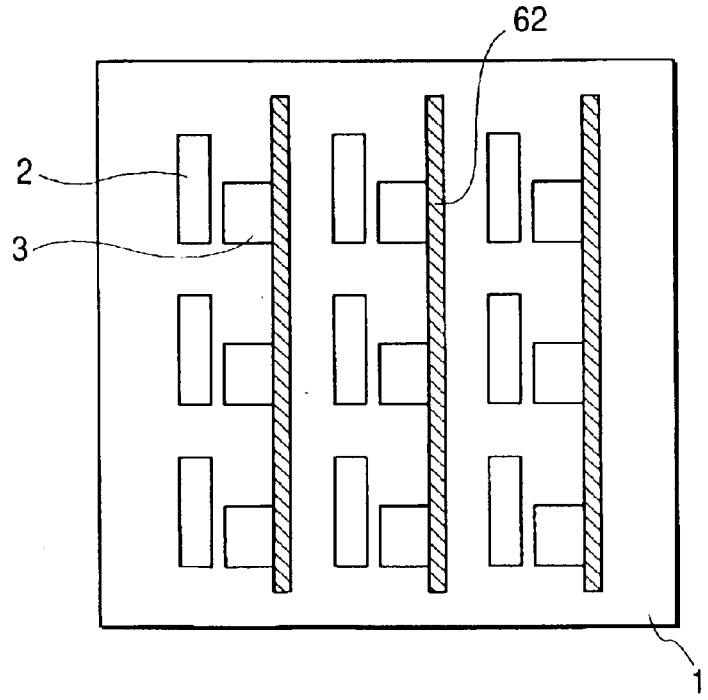
FIG. 6 is a schematic diagram showing an example of a manufacturing step of an electron source in a passive matrix arrangement according to the present invention.

(C) Next, lower wirings 62 are formed so as to cover parts of the electrodes 3 (FIG. 6). The lower wirings 62 may be formed by various methods, preferably a printing method. Among the printing methods, a screen printing method is preferable since the wirings can be formed on a large-area substrate at low cost.

Figure 7:
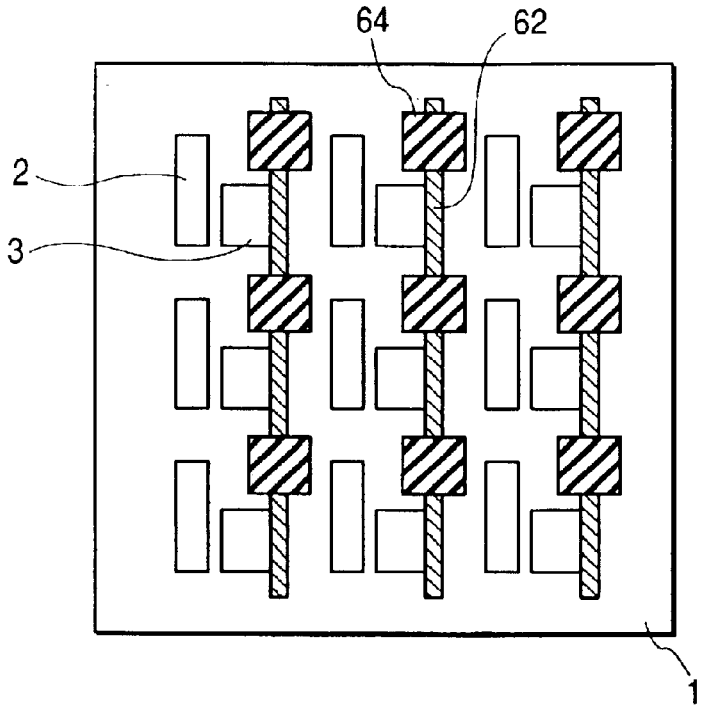
FIG. 7 is a schematic diagram showing an example of a manufacturing step of an electron source in a passive matrix arrangement according to the present invention.

(D) An insulating layer 64 is formed on an intersection portion of the lower wiring 62 and the upper wiring 63 formed in the subsequent step (FIG. 7). The insulating layer 64 may be also formed by using various methods, preferably a printing method. Among the printing methods, a screen printing method is preferable since the layer can be formed on a large-area substrate at low cost.

Figure 8:
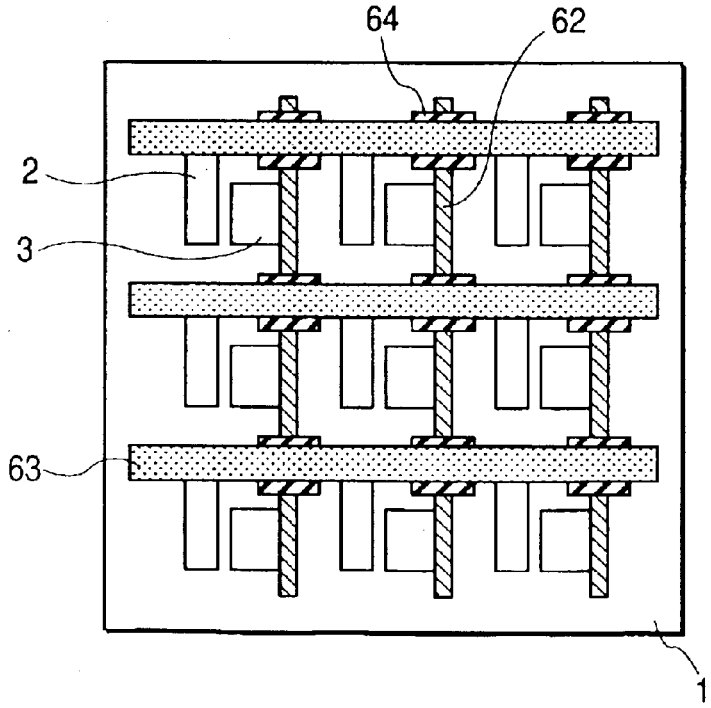
FIG. 8 is a schematic diagram showing an example of a manufacturing step of an electron source in a passive matrix arrangement according to the present invention.

(E) The upper wirings 63 are formed so as to substantially intersect with the lower wirings 62 (FIG. 8). The upper wirings 63 may be also formed by using various methods, preferably a printing method as in the case of the lower wirings 62. Among the printing methods, a screen printing method is preferable since the wirings can be formed on a large-area substrate at low cost.

Figure 9:
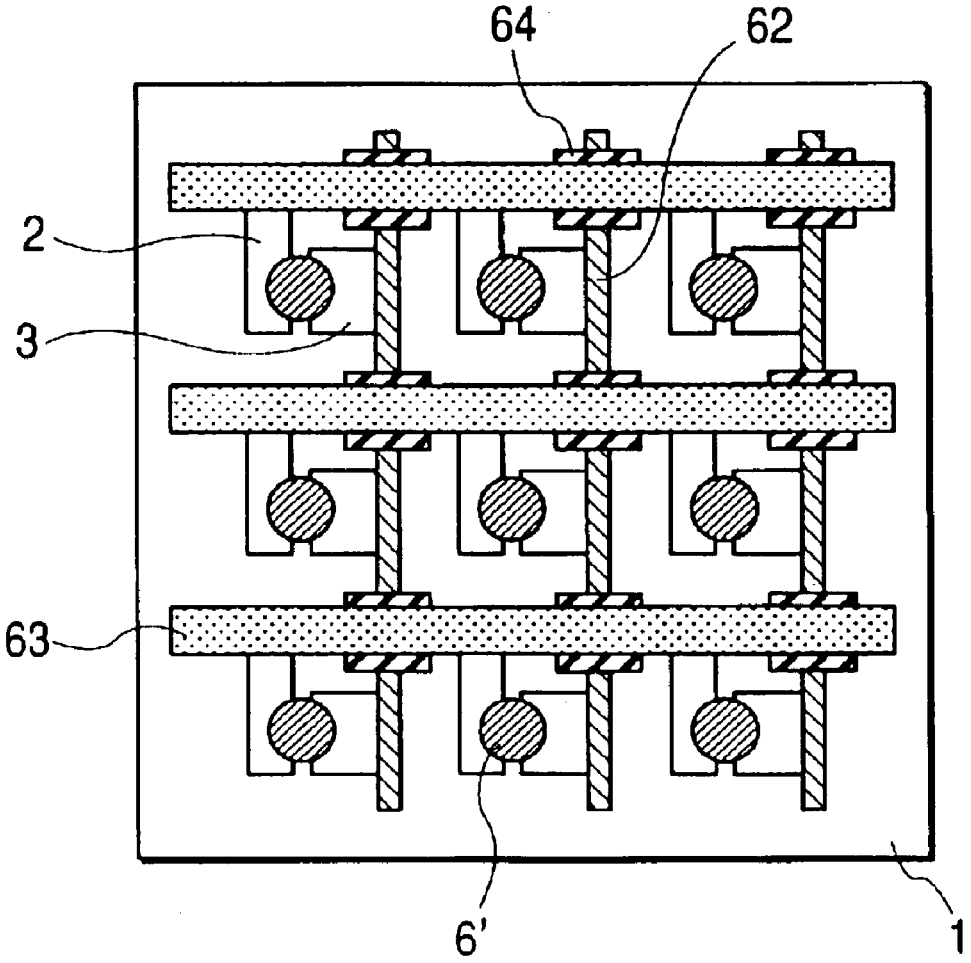
FIG. 9 is a schematic diagram showing an example of a manufacturing step of an electron source in a passive matrix arrangement according to the present invention.

(F) Next, the polymer film 6' is arranged so as to connect between each pair of electrodes 2 and 3 to form a unit (FIG. 9). In order to easily form the polymer film on the large-area substrate, a solution containing a precursor of the polymer film is preferably applied by the inkjet method. However, various methods other than the above method, for example, a spin-coating method, a printing method, and a dipping method can be applied thereto. Note that, when polyimide is used for the polymer film, in general, the precursor solution thereof is applied, followed by baking at 350° C. to turn it into imide (called "curing process") and to obtain polyimide as described above. However, it is also possible that the curing process is incorporated into the "resistance lowering process" in the subsequent step instead of performing curing in this step.

Figure 10A:
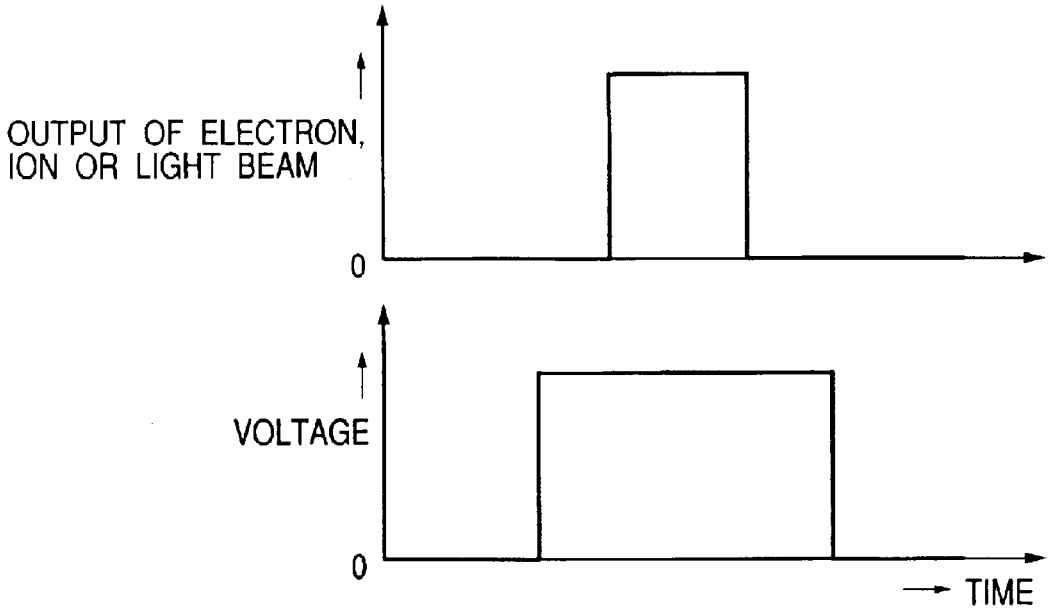
FIGS. 10A and 10B show an example of voltage application and timings at which a particle beam such as an electron beam or light is irradiated in a method of manufacturing an electron source according to the present invention.
Figure 10B:
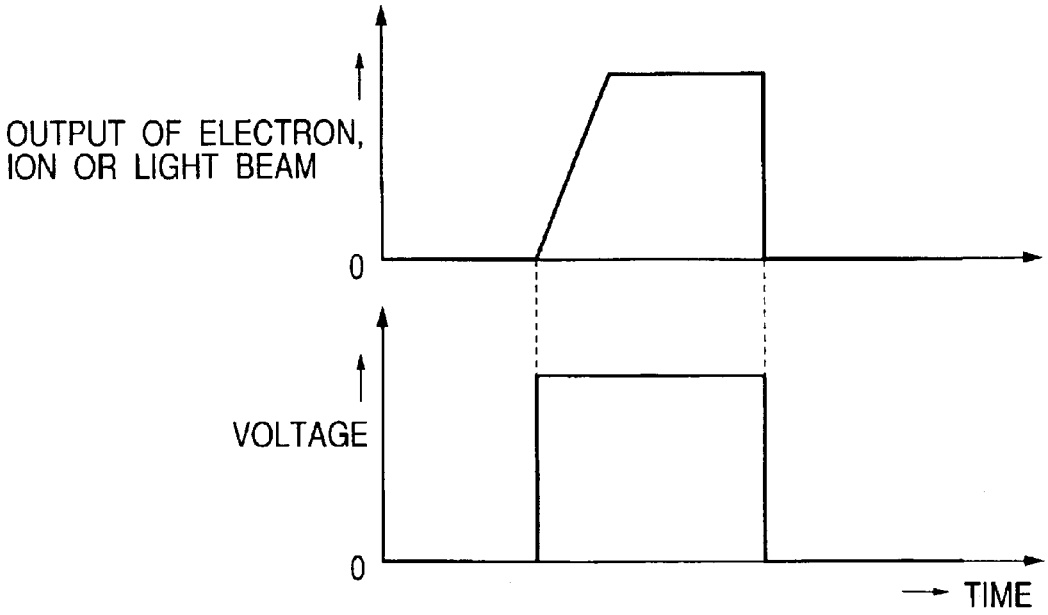

(G) Subsequently, the gap 5' is formed in the polymer film 6' in the above step (F). As for the formation of the gap 5', the constant voltage is applied to the wirings 62 and 63 and a potential difference is applied between the pair of electrodes constituting each of the plural units connected to the wirings. Thereafter, the plural units in a state of being applied with the potential difference are irradiated with the particle beam such as the electron beam or the ion beam, or light, so that the resistance (resistivity) lowering of the polymer film 6' and the formation of the gap 5' can be performed at a time. Note that, the applied voltage is preferably a pulse voltage and pulse input is conducted in synchronism with the particle beam irradiation or light irradiation. FIGS. 10A and 10B show an applied voltage and timings at which the particle beam such as the electron beam or ion beam, or light is irradiated by way of example.

FIG. 10A shows a method in which in a state where a voltage is applied in advance, the particle beam such as the electron beam or the ion beam, or light is irradiated and the voltage application is stopped after completion of the gap formation and the irradiation. Also, FIG. 10B shows a method in which irradiation of the particle beam such as the electron beam or the ion beam, or light is started and continued until the desired output value is reached by gradually increasing the output and then, the voltage application and the irradiation are stopped simultaneously after confirming that the gap is formed. Note that, the present invention is not particularly limited to the methods other than those shown in FIGS. 10A and 10B.

The above-mentioned aromatic polymer, particularly aromatic polyimide has a relatively high thermal decomposition temperature. When heated up to a temperature exceeding the thermal decomposition temperature, typically 700° C. to 800° C. or more, the aromatic polyimide can express conductivity. Note that if the entire substrate is heated up to such a temperature, not only the polymer film 6' but also other components may be damaged by overheating. According to the present invention, through the irradiation of the particle beam such as electron beam or ion beam, or light, only the polymer film 6' can be subjected to resistance lowering. More specifically, the rear plate 1 on which the plural electrodes 2 and 3 and the polymer film 6' are formed is placed on a stage in a non-oxidizing atmosphere such as inert gas atmosphere or vacuum atmosphere, and in a state where the voltage (potential difference) is applied to the plural electron-emitting devices (pairs of the electrodes 2,3), the polymer film 6' is irradiated with the particle beam such as electron beam or ion beam, or light.

When the electron beam is irradiated thereto as the particle beam, as the electron gun, for example, an electron gun of a cathode-ray tube can be used. Also, when the light is irradiated thereto, the laser or light using the xenon lamp or halogen lamp as a light source can be also used. Upon irradiation of the particle beam such as electron beam or ion beam, or light, the device to be irradiated is applied with voltage (potential difference) in advance, so that it is possible to monitor the resistance. Then, for example, at the time when the desired resistance value is obtained, the irradiation may be terminated. Alternatively, if the irradiation time is experimentally known, the resistance value does not need to be monitored as described above. Also, it is unnecessary to irradiate the particle beam such as electron beam or ion beam, or light over the polymer film 6' in its entirety. When a part of the polymer film 6' undergoes resistance lowering, the subsequent steps can be performed as well. As described above, the gap 5' can be formed in the film obtained by subjecting the polymer film 6' to resistance lowering to form the carbon film 6. The electron source having the plural electron-emitting devices formed on the substrate can be achieved (FIGS. 1A and 1B).

According to the present invention, prior to the irradiation of the light (including laser) or particle beam (including electron beam and ion beam), application of the potential difference between a pair of electrodes (polymer film) is started. In this way, it is not required to perform the potential difference application and the energy irradiation at the completely same time. This increases a process margin. As a result, the resistance (resistivity) lowering process of the polymer film and the gap forming process can be surely conducted with high uniformity. The value of the potential difference applied between the electrodes is such that if the potential difference is applied without irradiation of the light or particle beam, the gap cannot be substantially formed.

Incidentally, before the voltage application, if the light or particle beam is irradiated, the polymer film is undergoing gradually resistance lowering, so that the electron-emitting devices are difficult to manufacture with high uniformity. Therefore, in the present invention, prior to the energy beam (light or particle beam) irradiation, the potential difference is applied in advance and thus, the resistance lowering process of the polymer film and the gap forming process can be conducted with high uniformity.

Also, according to the present invention, it is not always necessary that all the devices formed on the rear plate 1 are applied with the potential difference. That is, all the devices (all units) are supposedly divided into a plurality of regions (blocks) and the resistance lowering process and the gap forming process can be sequentially performed for each region. In this way, particularly when the potential difference application is conducted through the wirings connected to the respective units, voltage drop of the wirings can be suppressed, with the result that the electron source and the image-forming apparatus with high uniformity can be obtained.

Figure 4:
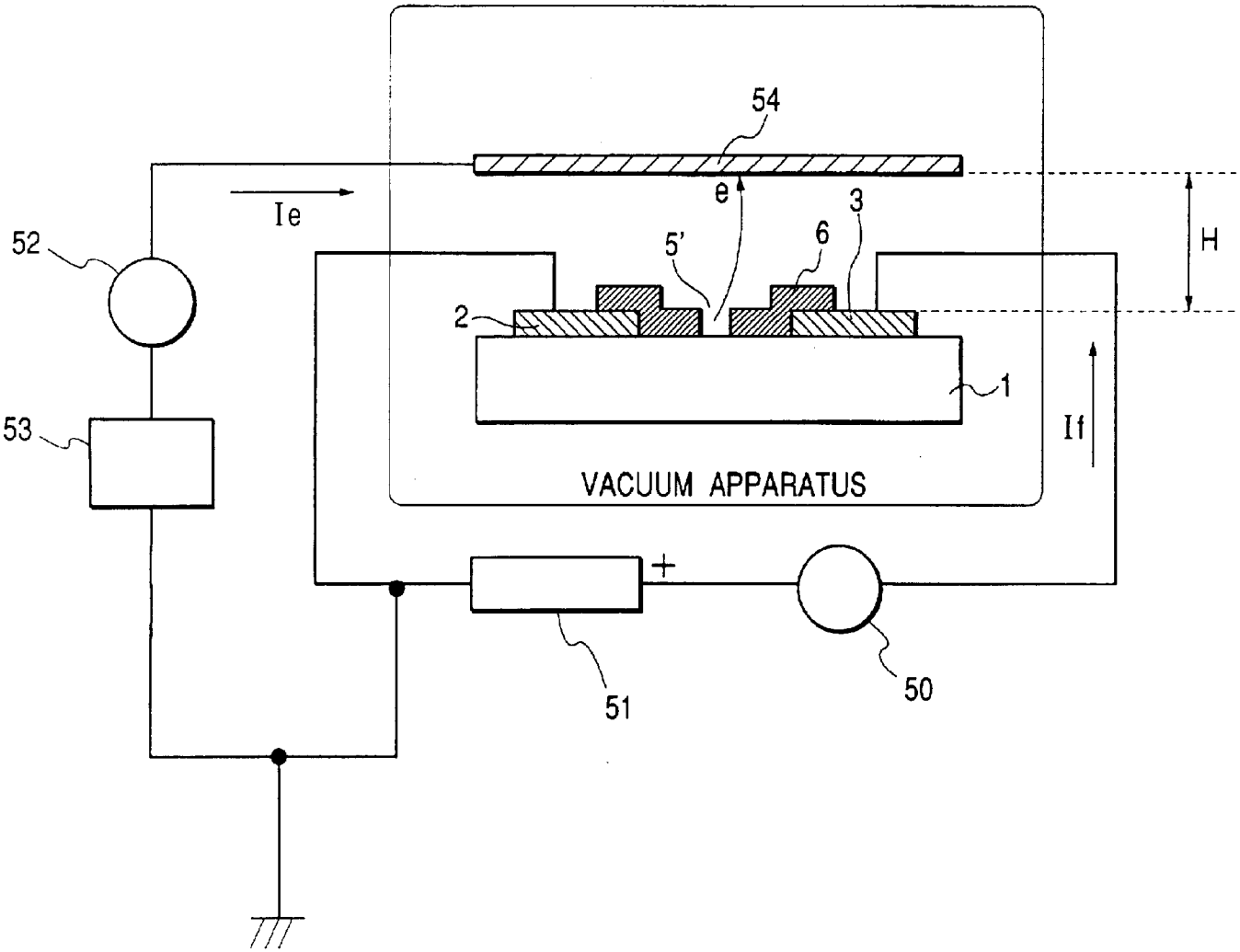
FIG. 4 is a schematic diagram showing an example of a vacuum apparatus provided with a measurement/evaluation function.
Figure 17:
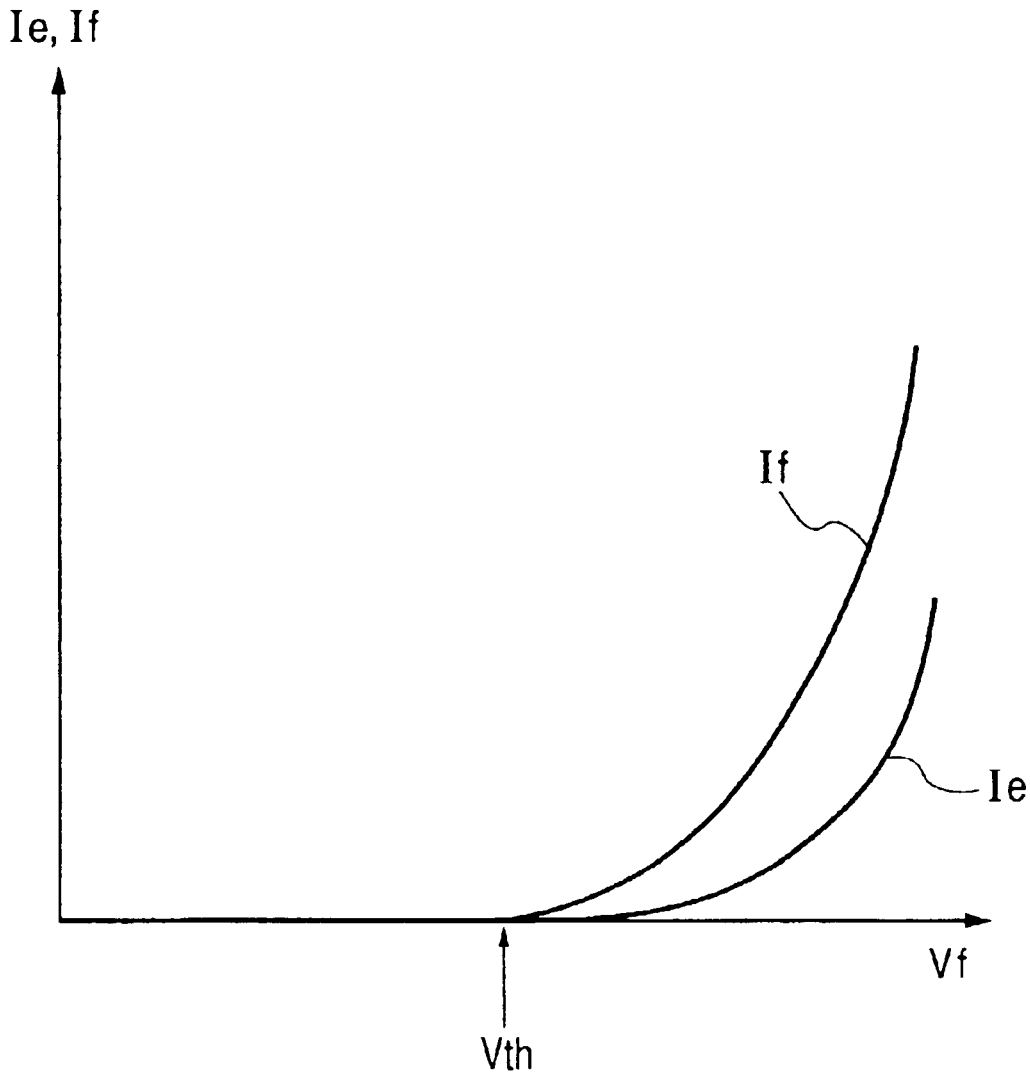
FIG. 17 is a schematic diagram showing electron-emitting characteristics of an electron source according to the present invention.

The electron source obtained through the above steps can be measured as to voltage/current characteristics using the measuring apparatus as shown in FIG. 4. The obtained characteristics are shown in FIG. 17. In FIG. 4, the same reference numerals as those used, for example, in FIGS. 1A and 1B denote the same members. Reference numeral 54 denotes an anode; 53, a high-voltage power source; 52, an ammeter for measuring an emission current Ie emitted from the electron-emitting device constituting the electron source; 51, a power source for applying a drive voltage Vf to each electron-emitting device; and 50, an ammeter for measuring a device current flowing between the electrodes 2 and 3. The electron-emitting device constituting the electron source has a threshold voltage Vth as shown in FIG. 17. Thus, when the voltage lower than the threshold voltage is applied between the electrodes 2 and 3, the electrons are not substantially emitted, whereas when the voltage higher than the threshold voltage is applied therebetween, the emission current (Ie) emitted from the device and the device current (If) flowing between the electrodes 2 and 3 start to develop. Then, passive matrix drive by which the desired device is selected and driven can be realized.

A method of manufacturing the image-forming apparatus using the electron source manufactured through the above steps will be subsequently described.

Figure 16A:
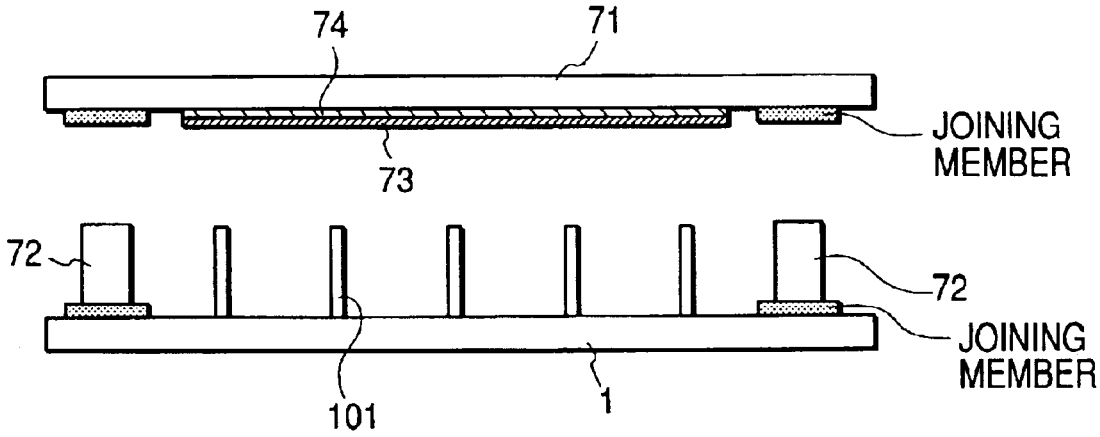
FIGS. 16A and 16B are schematic diagrams showing an example of manufacturing steps of an image-forming apparatus according to the present invention.

(H) The previously prepared face plate 71 on which the image-forming member constituted of, for example, the metal back 73 made of an aluminum film and the phosphor film 74 is formed and the rear plate 1 that has undergone the above steps (A) to (H) are aligned in position such that the metal back and the electron-emitting device face each other (FIG. 16A). A joining member is arranged on the contact surface (contact region) between the supporting frame 72 and the face plate 71. Similarly, the joining member is arranged on the contact surface (contact region) between the supporting frame 72 and the rear plate 1. As the above joining member, there is used one having a vacuum retaining function and an adhesion function. Specifically, frit glass, indium, indium alloy, or the like is used.

Figure 16B:
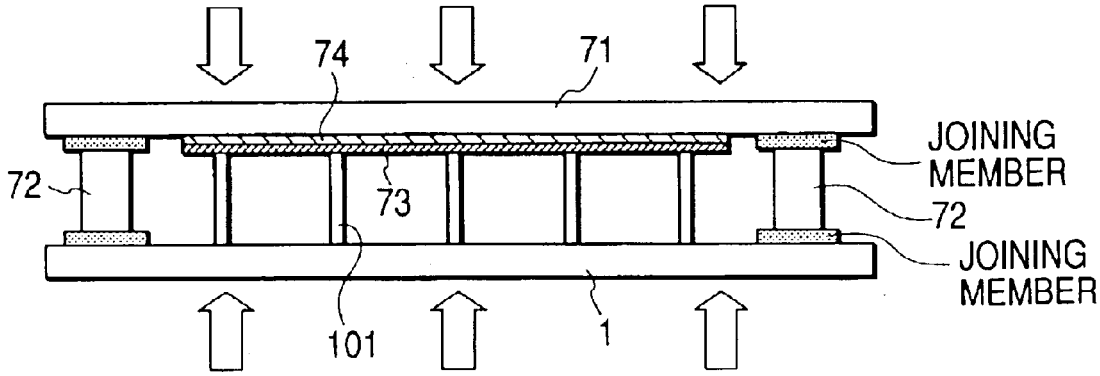

FIG. 16A shows an example in which the supporting frame 72 is fixed (adhered) by the joining member onto the rear plate 1 that has undergone the above steps (A) to (G) in advance. However, it is not always required that the supporting frame has been joined to the rear plate before this step (H). Also, similarly, FIGS. 16A and 16B show an example in which the spacer 101 is fixed onto the rear plate 1. However, it is not always required that the spacer 101 has been fixed onto the rear plate 1 before this step (H) as well.

Also, in an example shown in FIGS. 16A and 16B, the rear plate 1 is arranged on the lower side and the face plate 71 is arranged above the rear plate 1 for the sake of convenience. However, there arises no problem whichever exists on the upper side.

Further, in an example shown in FIGS. 16A and 16B, the supporting frame 72 and the spacer 101 are fixed (adhered) onto the rear plate 1 in advance, but they may be only mounted on the rear plate or face place so as to be fixed (adhered) thereonto in the subsequent "seal-bonding step".

(I) Next, the seal-bonding step shown in FIG. 16B is performed. The face plate 71 and the rear plate 1 arranged opposite to each other in the above step (H) are pressurized in the opposing direction while at least the joining member is heated. Upon the heating, the entire surfaces of the face plate and the rear plate are preferably heated in order to reduce the thermal distortion.

Note that, in the present invention, the above "seal-bonding step" is preferably performed in the reduced pressure (vacuum) atmosphere or in a non-oxidizing atmosphere. As the specific reduced pressure (vacuum) atmosphere, the pressure is preferably set to $10^{-5}$ Pa or less, more preferably to $10^{-6}$ Pa or less.

Through this seal-bonding step, the contact portions among the face plate 71, the supporting frame 72, and the rear plate 1 are brought into an airtightly joined state and at the same time, the airtight container 100 shown in FIG. 15 is obtained with the inside kept at a high vacuum.

Here, an example in which the "seal-bonding step" is performed in the reduced pressure (vacuum) atmosphere or in the non-oxidizing atmosphere is shown. However, the above "seal-bonding step" may be performed in the air. In this case, an exhaust pipe is additionally provided in the airtight container 100 for exhausting the space between the face and the rear plate and after the above "seal-bonding step", the exhaust pipe is used to exhaust the airtight container until the pressure of the inside thereof reaches $10^{-5}$ Pa or less. Thereafter, the exhaust pipe is tipped off to thereby obtain the airtight container 100 the inside of which is maintained at a high vacuum.

When the above "seal-bonding step" is performed in the air, in order to maintain the inside of the airtight container 100 at a high vacuum, it is preferable to include, between the above step (H) and step (I), the step of covering the metal back 73 (the surface of the metal back which faces the rear plate 1) with a getter material for removing the residual gases. At this time, the getter material to be used is preferably an evaporating getter because it simplifies the covering operation. Therefore, it is preferable to use barium for a getter film and to cover the metal back 73 with the getter film. Furthermore, the step of covering with the getter is performed under the reduced pressure (vacuum) atmosphere similarly to the case of the above step (I).

Also, in the example of the image-forming apparatus described above, the spacer 101 is arranged between the face plate 71 and the rear plate 1. However, if the size of the image-forming apparatus is small, the spacer 101 is not necessarily required. In addition, if the interval between the rear plate 1 and the face plate 71 is about several hundreds of $\mu$m, without using the supporting frame 72, the rear plate 1 can be also joined to the face plate 71 with the joining member. In such a case, the joining member serves as a member substitute for the supporting frame 72.

(Embodiments)

Hereinafter, the present invention will be described in more detail based on embodiments. However, the present invention is not limited to the embodiments described below.

(Embodiment 1)

A description will be given of Embodiment 1 of the present invention with reference to FIGS. 1A and 1B. FIGS. 1A and 1B show characteristics of the present invention most clearly.

In this embodiment, an image-forming apparatus 201 is formed using an electron source consisting of eighty devices in an X direction and forty devices in a Y direction. Referring to FIGS. 5 to 11 and FIGS. 15 to 16B, a method of manufacturing the image-forming apparatus schematically shown in FIG. 15 will be described.

Figure 11:
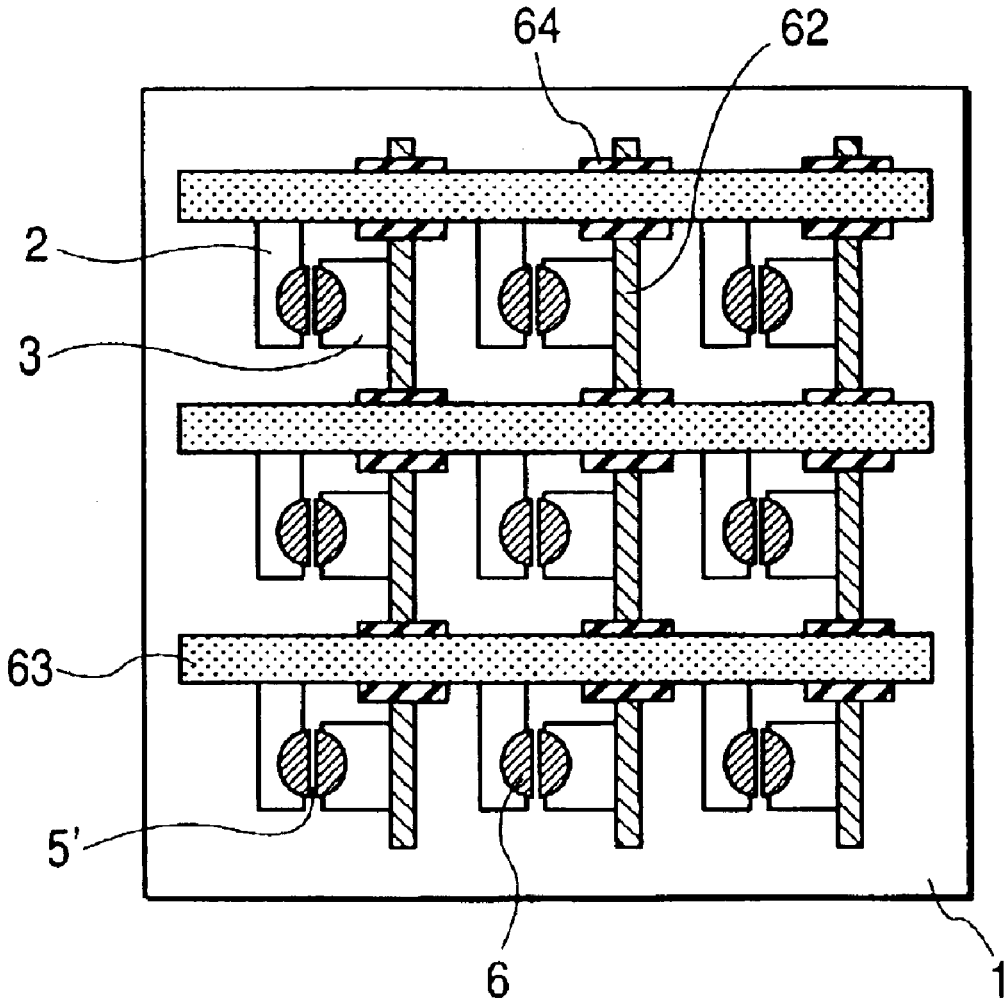
FIG. 11 is a schematic diagram showing an example of a manufacturing step of an electron source in a passive matrix arrangement according to the present invention.
Figure 12A:
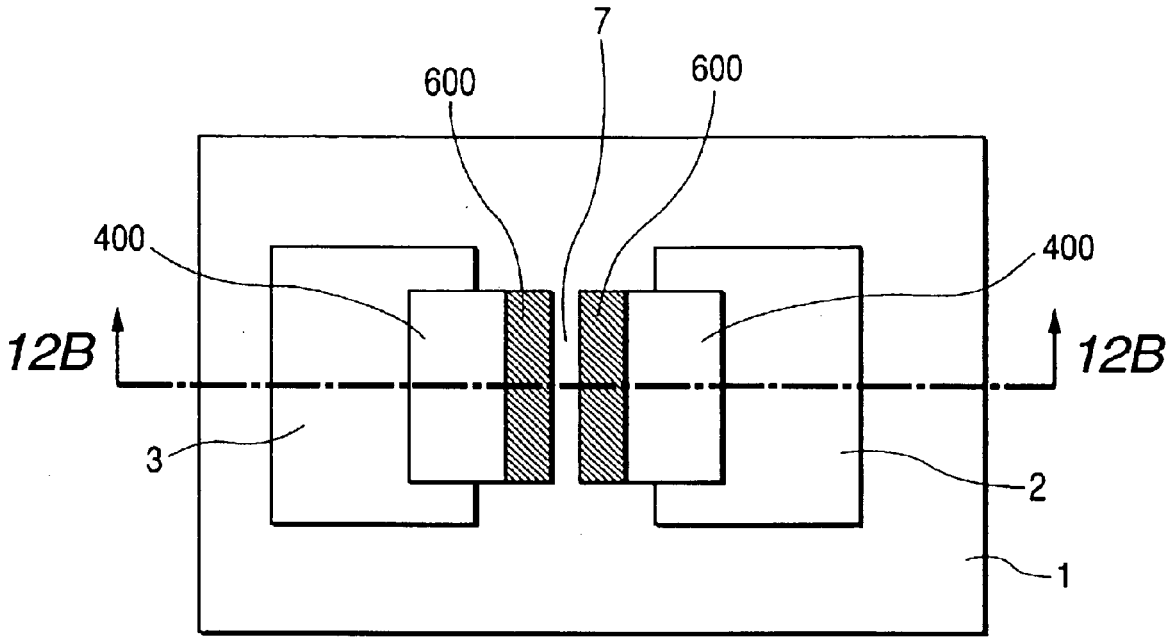
FIG. 12A PRIOR ART
Figure 12B:
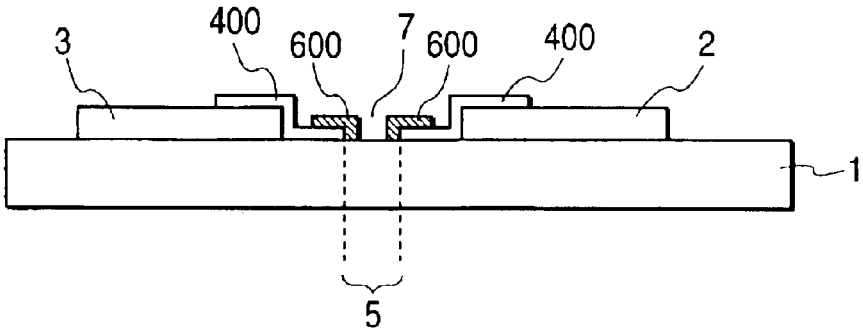
FIG. 12B PRIOR ART
Figure 13A:
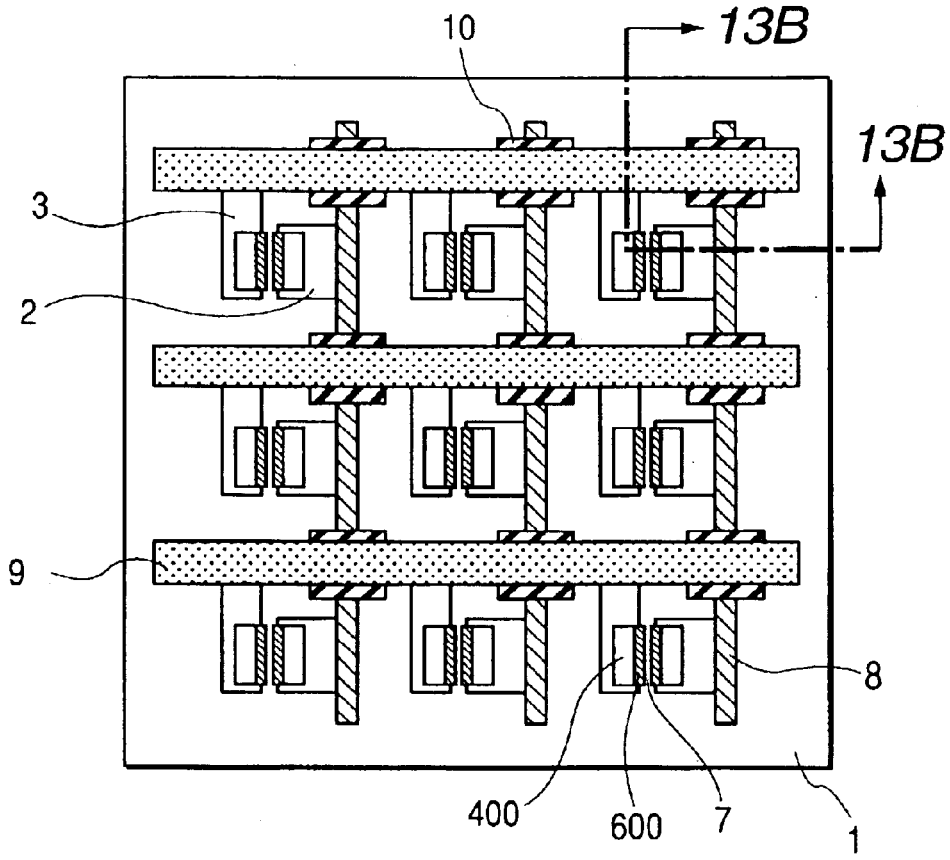
FIG. 13A PRIOR ART
Figure 13B:
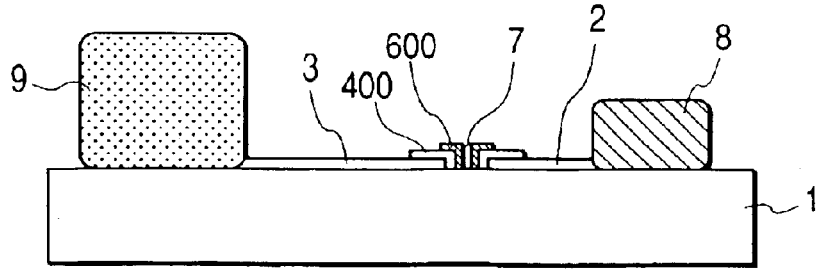
FIG. 13B PRIOR ART
Figure 14A:
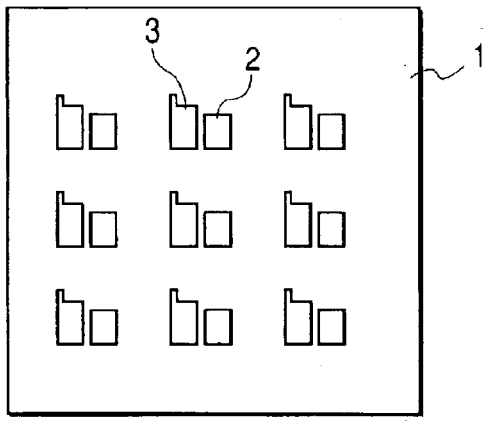
FIG. 14A PRIOR ART
FIGS. 14A, 14B, 14C, 14D, 14E and 14F are schematic diagrams showing an example of manufacturing steps of a conventional electron source.
Figure 14B:
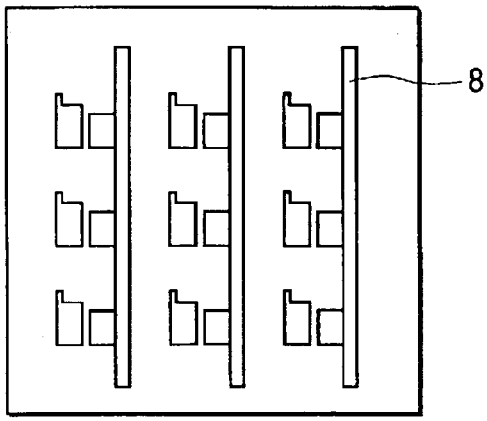
FIG. 14B PRIOR ART
Figure 14C:
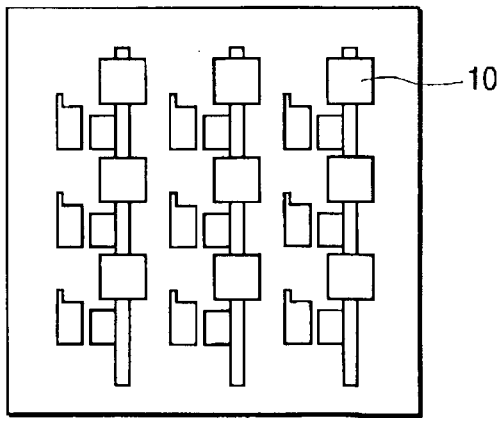
FIG. 14C PRIOR ART
Figure 14D:
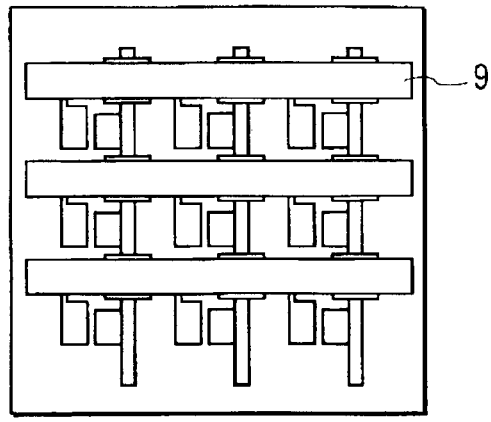
FIG. 14D PRIOR ART
Figure 14E:
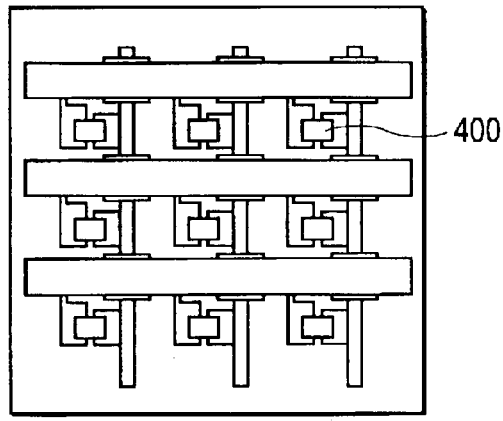
FIG. 14E PRIOR ART
Figure 14F:
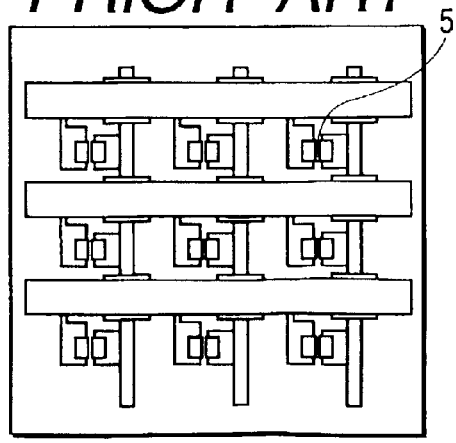
FIG. 14F PRIOR ART

FIG. 11 is an enlarged view schematically showing a part of the electron source composed of the rear plate, a plurality of electron-emitting devices formed thereon, and the wirings for applying signals to the plurality of electron-emitting devices. Reference numeral 1 denotes a rear plate; 2 and 3, electrodes; 5', a gap; 6, a carbon film; 62, X-directional wirings; 63, Y-directional wirings; and 64, interlayer insulating layers. Note that, the electrodes 2 and 3 and the carbon film 6 are supposedly combined into one set, which will be referred to as one unit. Also, FIG. 15 is a schematic diagram showing the image-forming apparatus using the electron source shown in FIG. 11. In FIG. 15, the same reference numerals as those in FIG. 11 denote the same members. Reference numeral 71 denotes a face plate obtained by laminating a phosphor film 74 and a metal back 73 made of Al on a glass substrate and 72 denotes a supporting frame. The rear plate 1, the face plate 71, and the supporting frame 72 constitute an airtight container 100 capable of being sealed with a vacuum condition.

Hereinafter, this embodiment will be described in the step order.

(Step 1)

On the glass base plate 1, Pt film having a thickness of 50 nm is deposited by a sputtering method, and the electrodes 2 and 3 formed of the Pt film are formed through a photolithography technique (FIG. 5). Note that, a distance between the electrodes 2 and 3 is set to 10 $\mu$m.

(Step 2)

Next, Ag paste is printed by a screen printing method, followed by heating and baking to form the X-directional wirings 62 (FIG. 6).

(Step 3)

Subsequently, insulating paste is printed by the screen printing method at intersection positions of the X-directional wirings 62 and the Y-directional wirings 63 formed in the subsequent step, followed by heating and baking to form the insulating layer 64 (FIG. 7).

(Step 4)

Further, the Ag paste is printed by the screen printing method, followed by heating and baking to form the Y-directional wirings 63, thereby forming matrix wirings on the substrate 1 (FIG. 8).

(Step 5)

A solution for the polymer film 6' is applied by an inkjet method to portions extending between the electrodes 2 and 3 of the substrate 1 on which the matrix wirings are formed as described above. In this embodiment, an N-methyl-pyrrolidone/2-butoxy ethanol solution containing 3% polyamide acid as a precursor of the polyimide is dropped and applied thereonto by the inkjet method. The resultant is baked at 130° C. and the solvent is removed to obtain the rear plate on which the circular polyimide precursor, which has a diameter of about 100 $\mu$m and a film thickness of 30 nm, is formed on the device (FIG. 9).

(Step 6)

Next, the rear plate 1 manufactured through the steps up to the step 5 is placed on the stage with a driving mechanism arranged inside the vacuum chamber. Subsequently, to all portions from which the X-directional wirings 62 and the Y-directional wirings 63 are led out in the rear plate inside the vacuum, one end of a probe is connected so as to attain conduction. The other end thereof is connected to the external power source to apply the voltage such that the potential difference is set to 8V in all the polymer films 6' connected to the above wirings. In this state, the electron gun arranged at the position facing the rear plate inside the vacuum is used to irradiate the electron beam (irradiation condition: acceleration voltage of 8 k-V and irradiation current density of 0.1 mA/mm$^2$) to the polymer film 6'. At this time, as for the relationship between the voltage application and the electron beam irradiation in a certain device, when the operations are performed as shown in FIG. 10A, the polymer films 6' in the three hundred and twenty units can be irradiated at a time. The stage is sequentially moved while continuing the voltage application and irradiation, so that the gap 5' is formed in a part of each polymer film 6' and the conductive region (carbon film 6) in which the resistance lowering has progressed is formed.

(Step 7)

Onto the rear plate 1 prepared as described above, the supporting flame 72 and the spacer 101 are adhered using the frit glass. Then, the rear plate 1 onto which the spacer and the supporting frame are adhered is arranged so as to face the face plate 71 (facing the surface on which the phosphor film 74 and the metal back 73 are formed to the surface on which the wirings 62 and 63 are formed) (FIG. 16A). Furthermore, the frit glass is applied onto the contact portion with the supporting frame 72 on the face plate 71 in advance.

(Step 8)

Subsequently, the face plate 71 and the rear plate 1 which are opposite to each other are subjected to seal-bonding by being heated and pressurized at 400° C. in a vacuum atmosphere at a pressure of $10^{-6}$ Pa (FIG. 16B). Through this step, the airtight container 100 the inside of which is maintained at a high vacuum is obtained. Thus, the image-forming apparatus 201 in this embodiment is manufactured. Note that, in the phosphor film 74, phosphors of the three primary colors (RGB) are arranged in a strip shape.

In the image-forming apparatus thus completed, the desired electron-emitting device is selected and applied with a voltage of 22 V through the X-directional wirings and the Y-directional wirings. Further, a voltage of 8 kV is applied to the metal back 73 through a high voltage terminal Hv. As a result, it is possible to form a satisfactory image that can be displayed brightly for a long period.

Note that, in the step 6 in this embodiment, when an $H^+$ ion beam is used instead of the electron beam, the image-forming apparatus having almost the same display characteristics as in Embodiment 1 can be manufactured.

(Embodiment 2)

In this embodiment, the image-forming apparatus 201 using the electron source including the eighty devices in the X direction and the forty devices in the Y direction is manufactured. In this embodiment, the steps corresponding to the step 1 through the step 5 are conducted similarly to Embodiment 1. Accordingly, the step 6 and the subsequent steps will be described below with reference to FIGS. 10A and 10B and FIGS. 15 to 17.

(Step 6)

The rear plate 1 manufactured through the steps up to the step 5 is placed on the stage with a driving mechanism arranged inside the vacuum chamber. Subsequently, to all portions from which the X-directional wirings 62 and the Y-directional wirings 63 are led out in the rear plate inside the vacuum, one end of the probe is connected so as to attain conduction. The other end thereof is connected to the external power source to apply the voltage such that the potential difference is set to 8 V in all the polymer films 6' connected to the above wirings. In this state, an optical fiber previously arranged at the position facing the rear plate inside the vacuum is used to irradiate the laser (irradiation condition: wavelength of 820 nm; output of 13 W; and irradiation diameter $\phi$ of 0.4 mm) to the polymer film 6'. At this time, as for the relationship between the voltage application and the laser irradiation in a certain device, when the operations are performed as shown in FIG. 10A, the polymer film 6' in one unit is irradiated at a time after positioning is sufficiently performed. The stage is sequentially moved while continuing the voltage application and irradiation, so that the gap 5' as well as the conductive region (carbon film 6) is formed in a part of each polymer film 6'.

(Step 7)

Onto the rear plate 1 manufactured as described above, the supporting flame 72 and the spacer 101 are adhered using the frit glass. Then, the rear plate 1 onto which the spacer and the supporting frame are adhered is arranged so as to face the face plate 71 (facing the surface on which the phosphor film 74 and the metal back 73 are formed to the surface on which the wirings 62 and 63 are formed) as in Embodiment 1 (FIG. 16A). Furthermore, the frit glass is applied onto the contact portion with the supporting frame 72 on the face plate 71 in advance.

(Step 8)

Subsequently, the face plate 71 and the rear plate 1 which are opposite to each other are subjected to seal-bonding by being heated and pressurized at 400° C. in a vacuum atmosphere at a pressure of $10^{-6}$ Pa (FIG. 16B). Through this step, the airtight container 100 the inside of which is maintained at a high vacuum is obtained. Thus, the image-forming apparatus 201 in this embodiment is manufactured. Note that, in the phosphor film 74, phosphors of the three primary colors (RGB) are arranged in a strip shape.

In the image-forming apparatus thus completed, the desired electron-emitting device is selected and applied with a voltage of 22 V through the X-directional wirings and the Y-directional wirings. Further, a voltage of 8 kV is applied to the metal back 73 through the high voltage terminal Hv. As a result, it is possible to form a satisfactory image that can be displayed brightly for a long period.

(Embodiment 3)

In this embodiment, the image-forming apparatus 201 using the electron source including the eighty devices in the X direction and the forty devices in the Y direction is manufactured. In this embodiment, the steps corresponding to the step 1 through the step 5 are conducted similarly to Embodiment 1. The step 6 and the subsequent steps will be described below with reference to FIGS. 10A and 10B and FIGS. 15 to 17.

(Step 6)

The rear plate 1 manufactured through the steps up to the step 5 is placed on the stage with a driving mechanism arranged inside the vacuum apparatus. Subsequently, to all portions from which the X-directional wirings 62 and the Y-directional wirings 63 are led out in the rear plate inside the vacuum container, one end of the probe is connected so as to attain conduction. The other end thereof is connected to the external power source to apply the voltage such that the potential difference is set to 8 V in all the polymer films 6' connected to the above wirings. In this state, an optical fiber previously arranged at the position facing the rear plate inside the vacuum is used to irradiate the light emitted from the xenon lamp as a light source (irradiation condition: wavelength of 350 nm to 1100 nm and irradiation diameter ϕ of 2.5 mm) to the polymer film 6'. At this time, as for the relationship between the voltage application and the Xenon light irradiation in a certain device, when the operations are performed as shown in FIG. 10A, the polymer films 6' in twenty units can be irradiated at a time. The stage is sequentially moved while continuing the voltage application and irradiation, so that the gap 5' as well as the conductive region (carbon film 6) is formed in a part of each polymer film 6'.

(Step 7)

Onto the rear plate 1 manufactured as described above, the supporting flame 72 and the spacer 101 are adhered using the frit glass. Then, the rear plate 1 onto which the spacer and the supporting frame are adhered is arranged so as to face the face plate 71 (facing the surface on which the phosphor film 74 and the metal back 73 are formed to the surface on which the wirings 62 and 63 are formed) as in Embodiment 1 (FIG. 16A). Furthermore, the frit glass is applied onto the contact portion with the supporting frame 72 on the face plate 71 in advance.

(Step 8)

Subsequently, the face plate 71 and the rear plate 1 which are opposite to each other are subjected to seal-bonding by being heated and pressurized at 400° C. in a vacuum atmosphere at a pressure of $10^{-6}$ Pa (FIG. 16B). Through this step, the airtight container the inside of which is maintained at a high vacuum is obtained. Thus, the image-forming apparatus 201 in this embodiment is manufactured. Note that, in the phosphor film 74, phosphors of the three primary colors (RGB) are arranged in a strip shape.

In the image-forming apparatus thus completed, the desired electron-emitting device is selected and applied with a voltage of 22 V through the X-directional wirings and the Y-directional wirings. Further, a voltage of 8 kV is applied to the metal back 73 through the high voltage terminal Hv. As a result, it is possible to form a satisfactory image that can be displayed brightly for a long period.

(Embodiment 4)

In this embodiment, the image-forming apparatus 201 using the electron source including the eighty devices in the X direction and the forty devices in the Y direction is manufactured. In this embodiment, the steps corresponding to the step 1 through the step 5 are conducted similarly to Embodiment 1. The step 6 and the subsequent steps will be described below with reference to FIGS. 10A and 10B and FIGS. 15 to 17.

(Step 6)

The rear plate 1 manufactured through the steps up to the step 5 is placed on the stage with a driving mechanism arranged inside the vacuum apparatus. Subsequently, to all portions from which the X-directional wirings 62 and the Y-directional wirings 63 are led out in the rear plate inside the vacuum, one end of the probe is connected so as to attain conduction. The other end thereof is connected to the external power source to apply the voltage such that the potential difference is set to 8V in all the polymer films 6' connected to the above wirings. In this state, through a quartz window arranged directly above the device on the rear plate, the laser (irradiation condition: wavelength of 820 nm and irradiation diameter ϕ of 0.4 mm) is irradiated to the polymer film 6' from outside the vacuum apparatus. At this time, as for the relationship between the voltage application and the laser irradiation in a certain device, the operations are performed as shown in FIG. 10A and one irradiation is performed on the unit basis. The stage is sequentially moved while continuing the voltage application and irradiation, so that the gap 5' as well as the. conductive region (carbon film 6) is formed in a part of each polymer film 6'.

(Step 7)

Onto the rear plate 1 manufactured as described above, the supporting flame 72 and the spacer 101 are adhered using the frit glass. Then, the rear plate 1 onto which the spacer and the supporting frame are adhered is arranged so as to face the face plate 71 (facing the surface on which the phosphor film 74 and the metal back 73 are formed to the surface on which the wirings 62 and 63 are formed) as in Embodiment 1 (FIG. 16A). Furthermore, the frit glass is applied onto the contact portion with the supporting frame 72 on the face plate 71 in advance.

(Step 8)

Subsequently, the face plate 71 and the rear plate 1 which are opposite to each other are subjected to seal-bonding by being heated and pressurized at 400° C. in a vacuum atmosphere at a pressure of $10^{-6}$ Pa (FIG. 16B). Through this step, an airtight container 100 the inside of which is maintained at a high vacuum is obtained. Thus, the image-forming apparatus 201 in this embodiment is manufactured. Note that, in the phosphor film 74, phosphors of the three primary colors (RGB) are arranged in a strip shape.

In the image-forming apparatus thus completed, the desired electron-emitting device is selected and applied with a voltage of 22 V through the X-directional wirings and the Y-directional wirings. Further, a voltage of 8 kV is applied to the metal back 73 through the high voltage terminal Hv. As a result, it is possible to form a satisfactory image that can be displayed brightly for a long period.

(Embodiment 5)

In this embodiment, the image-forming apparatus 201 using the electron source including the eighty devices in the X direction and the forty devices in the Y direction is manufactured. In this embodiment, the steps corresponding to the step 1 through the step 5 are conducted similarly to Embodiment 1. The step 6 and the subsequent steps will be described below with reference to FIGS. 10A and 10B and FIGS. 15 to 17.

(Step 6)

The rear plate 1 manufactured through the steps up to the step 5 is placed on the stage with a driving mechanism arranged inside the vacuum apparatus. Subsequently, to all portions from which the X-directional wirings 62 and the Y-directional wirings 63 are led out in the rear plate inside the vacuum, one end of the probe is connected so as to attain conduction. The other end thereof is connected to the external power source to apply the voltage such that the potential difference is set to 8V in all the polymer films 6' connected to the above wirings. In this state, through a quartz window arranged directly above the device on the rear plate inside the vacuum apparatus, the light emitted from the xenon lamp (irradiation condition: irradiation wavelength of 350 nm to 1100 nm and irradiation diameter ϕ of 2.5 mm) is irradiated onto the polymer film 6' from outside the vacuum apparatus. At this time, as for the relationship between the voltage application and the xenon light irradiation in a certain device, when the operations are performed as shown in FIG. 10A, the twenty units can be irradiated at a time. The stage is sequentially moved while continuing the energization application and irradiation, so that the gap 5' as well as the conductive region (carbon film 6) is formed in a part of each polymer film 6'.

(Step 7)

Onto the rear plate 1 manufactured as described above, the supporting flame 72 and the spacer 101 are adhered using the frit glass. Then, the rear plate 1 onto which the spacer and the supporting frame are adhered is arranged so as to face the face plate 71 (facing the surface on which the phosphor film 74 and the metal back 73 are formed to the surface on which the wirings 62 and 63 are formed) as in Embodiment 1 (FIG. 16A). Furthermore, the frit glass is applied onto the contact portion with the supporting frame 72 on the face plate 71 in advance.

(Step 8)

Subsequently, the face plate 71 and the rear plate 1 which are opposite to each other are subjected to seal-bonding by being heated and pressurized at 400° C. in a vacuum atmosphere at a pressure of $10^{-6}$ Pa (FIG. 16B). Through this step, an airtight container 100 the inside of which is maintained at a high vacuum is obtained. Thus, the image-forming apparatus 201 in this embodiment is manufactured. Note that, in the phosphor film 74, phosphors of the three primary colors (RGB) are arranged in a strip shape.

In the image-forming apparatus thus completed, the desired electron-emitting device is selected and applied with a voltage of 22 V through the X-directional wirings and the Y-directional wirings. Further, a voltage of 8 kV is applied to the metal back 73 through the high voltage terminal Hv. As a result, it is possible to form a satisfactory image that can be displayed brightly for a long period.

As described above, according to the present invention, the manufacturing process of the electron-emitting device and the electron source can be simplified and in addition, the image-forming apparatus capable of maintaining a superior display quality for a long period can be manufactured at low cost.

What is claimed is:

1. A method of manufacturing an electron source, the method comprising the steps of:

(A) providing a substrate on which are disposed a plurality of units, each unit including a pair of electrodes and a polymer film connecting the pair of electrodes;

(B) selecting one or more units from the plurality of units;

(C) applying a potential difference across the pair of electrodes that is included in each of the selected one or more units; and (D) irradiating light or a particle beam to the polymer film included in each of the selected one or more units in a state of being applied with the potential difference, wherein step (D) is started after step (C) is started.

2. The method of manufacturing the electron source according to claim 1, wherein the light or particle beam is sequentially irradiated to the polymer film that is included in each of the selected one or more units in a state of being applied with the potential difference.

3. The method of manufacturing the electron source according to claim 1, wherein the light is laser.

4. The method of manufacturing the electron source according to claim 1, wherein the light is emitted from a xenon lamp or a halogen lamp.

5. The method of manufacturing an electron source according to claim 1, wherein the particle beam is an electron beam or an ion beam.

6. The method of manufacturing an electron source according to claim 1, wherein the polymer film comprises any of aromatic polyimide, polyphenylene oxadiazole, and polyphenylene vinylene.

7. A method of manufacturing an image-forming apparatus which has an electron source and a light emitting member for emitting light due to irradiation of electrons emitted from the electron source, wherein the electron source is manufactured in accordance with the method according to claim 1.

8. The method of manufacturing the electron source according to claim 1, wherein the step (B), step (C) and step (D) are repeatedly performed.

9. The method of manufacturing an electron source according to claim 8, wherein the light is laser.

10. The method of manufacturing an electron source according to claim 8, wherein the light is emitted from a xenon lamp or a halogen lamp.

11. The method of manufacturing the electron source according to claim 8, wherein the particle beam is an electron beam or an ion beam.

12. The method of manufacturing an electron source according to claim 8, wherein the polymer film comprises any of aromatic polyimide, polyphenylene oxadiazole, and polyphenylene vinylene.

13. A method of manufacturing an image-forming apparatus which has an electron source and a light emitting member for emitting light due to irradiation of electrons emitted from the electron source, wherein the electron source is manufactured in accordance with the method according to claim 8.

14. A method of manufacturing an electron-emitting device, the method comprising the steps of:

(A) providing a substrate with a unit including a pair of electrodes and a polymer film connecting the pair of electrodes; and (B) applying a potential difference across the pair of electrodes; and (C) irradiating light or a particle beam to the polymer film in a state of being applied with the potential difference, wherein step (C) is started after step (B) is started.

* * * * *

UNITED STATES PATENT AND TRADEMARK OFFICE

CERTIFICATE OF CORRECTION

PATENT NO. : 6,910,935 B2
DATED : June 28, 2005
INVENTOR(S) : Yutaka Arai et al.

It is certified that error appears in the above-identified patent and that said Letters Patent is hereby corrected as shown below:

Title page, Item [54] and Column 1, line 1,
Title, "METHODS AND" should read -- METHODS OF --.

Column 2,
Line 66, "slelected" should read -- selected --.

Column 14,
Line 6, "flame 72" should read -- frame 72 --.

Column 15,
Lines 3 and 64, "flame 72" should read -- frame 72 --.

Column 16,
Line 52, "as the." should read -- as the --; and
Line 56, "flame 72" should read -- frame 72 --.

Column 17,
Line 49, "flame 72" should read -- frame 72 --.

Signed and Sealed this

Fourth Day of April, 2006

JON W. DUDAS
*Director of the United States Patent and Trademark Office*